US010562662B2

(12) United States Patent
Slooff et al.

(10) Patent No.: US 10,562,662 B2
(45) Date of Patent: Feb. 18, 2020

(54) CONTAINER INCLUDING OUTER FILM

(71) Applicant: PHILIP MORRIS PRODUCTS S.A., Neuchatel (CH)

(72) Inventors: Arjen Hamilcar Slooff, AH Rhenen (NL); Cassandra Sandra Alcocer Beltran, Lausanne (CH); Dorothy Tritz, Yverdon-les-Bains (CH); Lucas Chatelain, Lausanne (CH); Mathias Beutler, Vallon (CH)

(73) Assignee: Philip Morris Products S.A., Neuchâtel (CH)

( * ) Notice: Subject to any disclaimer, the term of this patent is extended or adjusted under 35 U.S.C. 154(b) by 97 days.

(21) Appl. No.: 15/761,516

(22) PCT Filed: Sep. 21, 2016

(86) PCT No.: PCT/IB2016/055626
§ 371 (c)(1),
(2) Date: Mar. 20, 2018

(87) PCT Pub. No.: WO2017/051325
PCT Pub. Date: Mar. 30, 2017

(65) Prior Publication Data

US 2019/0055052 A1 Feb. 21, 2019

(30) Foreign Application Priority Data

Sep. 25, 2015 (EP) ..... 15186992

(51) Int. Cl.
*B65D 5/62* (2006.01)
*B65D 85/10* (2006.01)
*B65D 5/54* (2006.01)

(52) U.S. Cl.
CPC ..... *B65D 5/62* (2013.01); *B65D 85/1045* (2013.01); *B65D 5/5485* (2013.01); *B65D 85/10* (2013.01)

(58) Field of Classification Search
CPC combination set(s) only.
See application file for complete search history.

(56) References Cited

U.S. PATENT DOCUMENTS 3,387,736 A * 6/1968 Williamson ..... A24F 15/12 220/270
3,498,448 A * 3/1970 Kuster ..... A61F 15/001 206/440

(Continued)

FOREIGN PATENT DOCUMENTS

CN 2741890 Y 11/2005
CN 201686186 U 12/2010

(Continued)

OTHER PUBLICATIONS

Extended EP Search Report for EP 15186992.2, dated Mar. 21, 2016 by the European Patent Office; 7 pgs.

(Continued)

*Primary Examiner* — Justin M Larson
(74) *Attorney, Agent, or Firm* — Mueting, Raasch & Gebhardt, P.A.

(57) ABSTRACT

A container includes a housing and an outer film. The housing has an inner surface, an outer surface, a rear wall and a circumferential length. The housing includes a box and a lid hingedly attached to the box at a hinge line on the rear wall of the housing. The housing also includes an opening line. The outer film is disposed on the outer surface of the housing. The outer film includes a covering portion and an opening portion. The opening portion has a length that is less than the circumferential length of the housing and the (Continued)

opening portion is disposed along the opening line of the housing.

20 Claims, 3 Drawing Sheets

(56) References Cited

U.S. PATENT DOCUMENTS

| | | | | | |
|---|---|---|---|---|---|
| 4,938,363 | A * | 7/1990 | Amendola | B29C 59/007 206/264 |
| 4,947,994 | A | 8/1990 | Newsome | |
| 5,192,262 | A * | 3/1993 | Amendola | B29C 59/007 493/364 |
| 7,290,652 | B2 * | 11/2007 | Rath | B65D 75/5827 206/242 |
| 8,118,161 | B2 * | 2/2012 | Guerrera | B65D 77/003 206/274 |
| 8,794,837 | B2 * | 8/2014 | Hanus | B32B 7/05 383/207 |
| 10,081,484 | B2 * | 9/2018 | Pilzecker | B65D 85/1018 |
| 10,308,412 | B2 * | 6/2019 | Polikeit | B65D 75/5805 |
| 2011/0284534 | A1 | 11/2011 | Frizell et al. | |
| 2019/0055052 | A1 * | 2/2019 | Slooff | B65D 85/1045 |

FOREIGN PATENT DOCUMENTS

| | | | | |
|---|---|---|---|---|
| CN | 102256874 | A | 11/2011 | |
| CN | 204197657 | U | 3/2015 | |
| DE | 2652079 | A1 | 5/1978 | |
| DE | 19605112 | A1 * | 8/1996 | B65D 5/62 |
| FR | 1482616 | A | 5/1967 | |
| GB | 2297966 | A | 8/1996 | |
| GB | 2533594 | A * | 6/2016 | B65D 85/1045 |
| RU | 2242415 | C2 | 12/2004 | |
| WO | WO 03/070601 | A1 | 8/2003 | |
| WO | WO 2014/146957 | A1 | 9/2014 | |

OTHER PUBLICATIONS

International Search Report and Written Opinion, issued for PCT/IB2016/055626, dated Nov. 3, 2016, by the European Patent Office; 12 pgs.

Written Opinion of the International Preliminary Examining Authority, issued for PCT/IB2016/055626, dated Sep. 19, 2017 by the International Bureau of WIPO; 5 pgs.

International Preliminary Report on Patentability issued for PCT/IB2016/055626, dated Jan. 5, 2018, by the International Bureau of WIPO; 21 pgs.

Innovia Films: "GLS20 Propafilm Datasheet", Oct. 1, 2012; 2 pgs.

Chinese Office Action for CN Application No. 201680050823.2, dated Mar. 19, 2019; including English translation; 12 pgs.

Russian Official Decision to Grant dated Dec. 12, 2019, for RU Application No. 2018114649; 15 pgs. including English Translation.

* cited by examiner

CONTAINER INCLUDING OUTER FILM

This application is the § 371 U.S. National Stage of International Application No. PCT/IB2016/055626, filed 21 Sep. 2016, which claims the benefit of European Application No. 15186992.2, filed 25 Sep. 2015, the disclosures of which are incorporated by reference herein in their entireties.

The present invention relates to a container for consumer goods with an outer film where at least a portion of the outer film remains on the container after the container is opened. The container finds particular application as a container for elongate smoking articles such as cigarettes.

Previously, once a container had been opened, the upper part, especially, of the wrapper film is typically removed from the container.

One object of the invention is to provide a container for consumer goods that comprises an outer film where less material is removed upon opening.

In one aspect of the present invention, a container is described. The container comprises a housing that has an inner surface and an outer surface, a rear wall and a circumferential length. The housing comprises a box and a lid that is hingedly attached to the box. The hinge and box are hingedly attached at the hinge line on the rear wall of the housing. The opening line, which defines the hinge and the box respectively, extends away from the ends of the hinge line around the remainder of the housing. The container also includes an outer film that is disposed on the outer surface of the housing. The outer film comprises a covering wrapper and an opening portion. The opening portion has a length that is less than the circumferential length around the housing. The opening portion of the outer film is generally disposed along the opening line of the housing. The opening portion is removed from the container before or while the container is opened.

In some aspects of the invention, the outer film comprises one or more lines of weakness. In some aspects of the invention, the outer film can be a multilayer film. When the outer film is a multilayer film the multilayer film can comprises a first layer, a second layer and optionally an adhesive layer. The first layer can comprise one or more lines of weakness. The second layer can comprise one or more lines of weakness. The optional adhesive layer disposed between the first and second layer can comprise more than one kind of adhesive.

In some aspects of the invention, the opening portion of the outer film can also comprises an optional tearing component, for example a tear tape placed or disposed over at least a portion of the opening portion, for example over a line of weakness.

Other objects of the present invention will be evident to those of skill in the art upon reading and understanding the present disclosure, which includes the claims that follow and the accompanying drawings.

Various aspects of the present invention may provide one or more advantages relative to currently-available or previously-described containers. For example, a container that allows easy opening by a consumer but still maintains the wrapper around the hinge between the box and the lid could provide protection to the hinge area. The outer film, because it stays substantially on the entire container could also more effectively provide a base support for design elements, various texturizing treatments, other features, or combinations thereof. Because the outer film remains substantially on the entire container the same texture can be provided on the entire surface of the container, the entire surface of the container can be variably texturized in a way that is maintained after opening, or some combination thereof. Furthermore, containers that include an outer film that is a multilayer film can offer advantages over other containers because the film does not have to "broken" and instead only a portion of the first layer needs to be removed to allow the container to be opened.

The present invention is applicable to any suitable container for consumer goods such as for example elongate smoking articles. It is known to package consumer goods such as, for example, elongate smoking articles in containers formed from folded laminar blanks. For example, elongate smoking articles, such as cigarettes and cigars, are commonly sold in hinge lid packs having a box for housing the smoking articles and a lid connected to the box about a hinge line extending across the back wall of the container.

The container may take any suitable form for housing consumer goods. For example, as already mentioned, the container may comprise a housing that can be described as a hinge-lid container having one or more hinged lids connected to a box housing the consumer goods. In one or more embodiments, the container may be a slide and shell container having an inner slide for housing the consumer goods mounted within an outer shell. Where the container is a slide and shell container, the outer shell or the inner slide may include one or more hinge lids. The container may be formed from any suitable materials including, but not limited to, cardboard, paperboard, plastic, metal, other materials, or combinations thereof. The cardboard may have a weight of between about 100 grams per square meter and about 350 grams per square meter.

Containers described herein will generally have the same or a similar shape as the housing. As such housings according to the invention may be in the shape of a rectangular parallelepiped, with right-angled longitudinal and right-angled transverse edges. Alternatively, the housing may comprise one or more rounded longitudinal edges, rounded transverse edges, bevelled longitudinal edges, or bevelled transverse edges, other types of edges, or combinations thereof. For example, the housing according to the invention may comprise, without limitation, one or more of the following features:

- one or two longitudinal rounded or bevelled edges on at least one of the front wall and the back wall;
- one or two transverse rounded or bevelled edges on at least one of the front wall and the back wall;
- one longitudinal rounded edge and one longitudinal bevelled edge on the front wall, or one transverse rounded edge and one transverse bevelled edge on the back wall;
- one longitudinal rounded edge and one longitudinal bevelled edge on the front wall, and one transverse rounded edge and one transverse bevelled edge on the back wall;
- one or two transverse rounded or bevelled edges on the front wall and one or two longitudinal rounded or bevelled edges on the front wall; and
- two longitudinal rounded or bevelled edges on a first side wall or two transverse rounded or bevelled edges on the second side wall.

Where the housing comprises one or more rounded edges, preferably the blanks forming the housing comprise three, four, five, six, or seven scoring lines or creasing lines to form each rounded edge in the assembled container. The scoring lines or creasing lines may be either on the inside of the housing or on the outside of the housing. Preferably, the scoring lines or creasing lines are spaced from each other by between about 0.3 millimetres (mm) and 4 mm.

Preferably, the spacing of the creasing lines or scoring lines is a function of the thickness of the laminar blank. Preferably, the spacing between the creasing lines or scoring lines is between about 0.5 and about 4 times larger than the thickness of the laminar blank.

Where the housing comprises one or more bevelled edges, preferably the bevelled edge has a width of between about 1 mm and about 10 mm, preferably between about 2 mm and about 6 mm. In one or more embodiments, the housing may comprise a double bevel formed by three parallel creasing or scoring lines that are spaced such that two distinct bevels are formed on the edge of the container. Where the housing comprises a bevelled edge, the bevel may be formed by two parallel creasing lines or scoring lines in the laminar blank from which the container is formed. The creasing lines or scoring lines may be arranged symmetrically to the edge between a first wall and a second wall. Alternatively, the creasing lines or scoring lines may be arranged asymmetrically to the edge between the first wall and the second wall, such that the bevel reaches further into the first wall of the container than into the second wall of the housing.

Alternatively, the housing may have a non-rectangular transverse cross section, for example, polygonal such as triangular or hexagonal, or oval, semi-oval, circular or semicircular.

Containers according to the invention find particular application as packs for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes. Through an appropriate choice of the dimensions thereof, containers or housings according to the invention may be designed to hold different total numbers of smoking articles, or different arrangements of smoking articles. For example, through an appropriate choice of the dimensions thereof, containers or housings according to the invention may be designed to hold a total of between ten and thirty smoking articles.

As well as housing a bundle of smoking articles, the container may further comprise other consumer goods, for example, matches, lighters, extinguishing means, breath-fresheners, or electronics. The other consumer goods may be attached to the outside of the container, contained within the container along with the smoking articles, in a separate compartment of the container, or any combination thereof.

The housing has an inner surface and an outer surface. The housing also has a rear wall, a front wall and two side walls. The housing can be described by a circumferential length. The circumferential length of the housing is the length around the entire housing, the length around the front wall, one side wall, the rear wall and the other side wall. The housing comprises a lid and a box.

The lid of the housing is hingedly attached to the box and is adapted to be manipulated between an open position and a closed position. In the open position, the consumer can access the consumer goods disposed within the housing. The lid is hingedly attached to the box along a hinge line that extends across the rear wall of the housing. The term "hinge line" refers to a line about which the lid may be pivoted to open the housing or the container. A hinge line may be, for example, a fold line or a score line in the panel forming the back wall of the housing. The lid and box are further defined by an opening line. The opening line refers to the delineation between the lid and the box which begins at one end of the hinge line traverses the right side of the housing, the front of the housing then the left side of the housing, or vice versa, and ends at the other end of the hinge line. The opening line can also be described as extending circumferentially around a portion of the housing. The box comprises a box front wall, a box left side wall, a box right side wall, a box back wall, and a box bottom wall. The lid comprises a lid front wall, a lid left side wall, a lid right side wall, a lid back wall, and a lid top wall.

Containers according to the invention also comprise an outer film. The outer film has an inner surface and an opposing outer surface. The outer film is generally positioned outside the housing, more specifically the inner surface of the outer film is disposed on the outer surface of the housing. Preferably, the inner surface of the outer film is affixed to or attached to at least some portion of the outer surface of the housing. Preferably, the inner surface of the outer film is affixed or attached to at least one point on the box and at least one point on the lid of the housing. Any suitable technique or combination of techniques can be utilized to affix a portion of the inner surface of the outer film to a portion of the box, the lid, or both. The outer film can be attached to the outer surface of the housing for example by adhering it to the outer surface through use of an adhesive, by heat shrinking it around the outer surface, by ultrasonic treatment, by the use of suction features, for example YUPOTako® from YUPO EUROPE GMBH), by other methods, or by any combination thereof.

The outer film can be made of any suitable materials, for example, polymeric materials, metal foils, other materials, or combinations thereof. The outer film preferably comprises polymeric materials such as polyethylene films, polyolefin films, poly lactic acid (PLA) films, or some combination thereof.

The outer film comprises a covering portion and an opening portion. The covering portion remains on the housing once the container has been opened. The covering portion makes up most of the outer film. Preferably, the covering portion makes up at least about 90 percent of the outer film, about 95 percent of the outer film, even more preferably at least about 98 percent of the outer film. In some embodiments, the covering portion makes up substantially 100 percent of the outer film.

The opening portion is removed from the container upon opening. The opening portion of the outer film can comprise one or more lines of weakness, a tear away portion, other components, or any combination thereof. One or more parts of the opening portion of the outer film can be in contact with a label before the container has been opened. The opening portion has a length that is less than the circumferential length around the housing of the container.

The opening portion of the outer film generally follows or is disposed along the opening line of the housing when the outer film is disposed on the housing. Preferably, the opening portion of the outer film is disposed adjacent the opening line of the housing when the outer film is disposed on the housing. More preferably, the opening portion of the outer film is disposed not more than about 5 mm perpendicularly away from the opening line of the housing when the outer film is disposed on the housing, or even more preferably the opening portion of the outer film is disposed not more than about 3 mm perpendicularly away from the opening line of the housing when the outer film is disposed on the housing.

The opening portion can include one or more lines of weakness. Some opening portions can comprise a single line of weakness that can be broken to open the container. Some opening portions can comprise at least two lines of weakness where a tear away portion, which exists between the two lines of weakness can be removed to open the container.

Some opening portions can include two lines of weakness on the outer surface of the outer film and a third line of weakness on the inner surface of the outer film, with a tear away portion disposed between the two lines of weakness on the outer surface.

Lines of weakness can be formed using any available methods. Preferably, lines of weakness can be formed by mechanical cutting; by use of a laser; by degrading a portion of the outer film using ultraviolet (UV) energy, infrared (IR) energy, Gamma energy, X-ray energy, chemical treatment, thermal treatment, galvanic treatment, other treatments, or any combination thereof; or any combination thereof. Lines of weakness can be formed before the outer film is applied to the housing of the container, after the outer film is applied to the container, or using a combination thereof.

A line of weakness need not be continuous, and can for example include an offset portion. A line of weakness can be described by its thickness. The thickness can describe the thickness of the cut in the outer film or the depth to which the degradation extends in the outer film, for example. Preferably, a line of weakness has an average thickness of not less than about 1 micrometre, not less than about 2 micrometres, or not less than about 3 micrometres. Preferably, a line of weakness has an average thickness of not greater than about 50 micrometres, not greater than about 40 micrometres, not greater than about 20 micrometres, or not greater than about 10 micrometres, for example. A line of weakness can also have different depths at different points. A line of weakness can also be described by the force necessary to break the outer film at the line of weakness. Preferably, a line of weakness, whether the line of weakness is a cut, slit or perforation in the outer film or degradation of a portion of the outer film, may require a force not greater than about 12 Newtons to break.

Some opening portions can include a line of weakness or a portion of a line of weakness that extends through the entire thickness of the outer film. Preferably, a tear away label can be applied over such a line of weakness to maintain the integrity of the container before opening, to assist in opening the container, or both. In some embodiments, the outer film may be a multilayer structure. Such multilayer structures can comprise at least a first layer and a second layer. The first layer and the second layer are disposed adjacent each other to form a laminate. A multilayer structure for use as the outer film can also comprise additional layers between the first and second layer. Such additional layers can comprise one or more adhesives and will be discussed below.

The first layer can preferably form the outer surface of the outer film. Preferably, the first layer is polymeric. For example the first layer can comprise polyethylene films, polyolefin films, poly lactic acid (PLA) films, other polymeric films, other polymeric films, or any combination thereof. The first layer has an inner and an outer surface. Preferably, the outer surface of the first layer forms the outer surface of the outer film.

The first layer can comprise at least one line of weakness. Preferably the first layer comprises a second line of weakness as well as a first line of weakness. Such first and second lines of weakness can be positioned such that they are on opposite sides of the opening line of the housing when the outer film is disposed on the housing. Preferably, the first and second lines of weakness are disposed adjacent opposites sides of the opening line of the housing when the outer film is disposed on the housing. Preferably, the first and second lines of weakness straddle the opening line. More preferably, the first and second lines of weakness are disposed not more than about 5 mm perpendicularly from opposite sides of the opening line of the housing when the outer film is disposed on the housing. Even more preferably the first and second lines of weakness are disposed not more than about 3 mm perpendicularly from opposite sides of the opening line of the housing when the outer film is disposed on the housing.

Upon opening a container with an outer film that is a multilayer film where the first layer has first and second lines of weakness for the first time, the portion of the first layer between the first and second line of weakness, the opening portion, is removed from the container and the container opens or can be opened. The first and second lines of weakness can remain with the covering portion of the outer film, can be removed with the opening portion of the outer film, can be removed separately from the opening portion of the outer film, or some combination thereof. Once the container has been opened, the covering portion, with or without one or more of the lines of weakness, stays with the housing. Preferably, once the container has been opened, the covering portion stays affixed or attached to at least some portion of the housing.

As discussed above, some outer films may be a multilayer structure and may comprise at least a first layer and a second layer. The second layer can preferably form the inner surface of the outer film. Preferably, the second layer is polymeric. For example the second layer can comprise polyethylene films, polyolefin films, poly lactic acid (PLA) films, other polymeric films, or any combination thereof. The first layer and the second layer can be made of the same or different materials. The second layer has an inner and an outer surface. Preferably, the inner surface of the second layer forms the inner surface of the outer film.

The second layer can comprise at least one line of weakness, a third line of weakness. Preferably, the second layer of a multilayer outer film can comprise one line of weakness. Preferably, a line of weakness in the second layer can be positioned adjacent the opening line of the housing when the outer film is disposed on the housing. Preferably, a line of weakness in the second layer can substantially follow the entire opening line of the housing when the outer film is disposed on the housing. The line of weakness in the second layer can also be described as being positioned between the first and second line of weakness in the first layer. Preferably, the line of weakness in the second layer is disposed not more than about 2 mm perpendicularly from the opening line of the housing when the outer film is disposed on the housing. Even more preferably the line of weakness in the second layer is disposed not more than about 1 mm perpendicularly away from the opening line of the housing when the outer film is disposed on the housing.

Upon opening the container for the first time, the portion of the first layer between the first and second lines of weakness, the opening portion, is removed from the outer film; the line of weakness in the second layer is broken; and the container opens or can be opened. Until the line of weakness in the second layer is broken, the outer film remains unbroken. Preferably, forcing the lid back after the first and second lines of weakness have been broken breaks the second layer of the multilayer film at the location of the third line of weakness.

As discussed above, some outer films may be a multilayer structure and may comprise at least a first layer, a second layer and an adhesive layer disposed between the first and second layers. The adhesive layer can comprise one or more than one type of adhesive. Any suitable adhesive or combination of adhesives can be utilized. Preferably, the adhesive layer includes a portion that is made up of a permanent adhesive and a portion that is made up of a non-permanent adhesive.

Preferably, the portion of the adhesive layer that is located adjacent to the first layer between the first and second lines of weakness can be a non-permanent adhesive. This area of non-permanent adhesive allows the first layer and the second layer to separate from each other in this region. Therefore, when the first and second lines of weakness in the first layer are broken, the opening portion of the first layer can be removed from the second layer due to the non-permanent nature of the adhesive in this region. Even more preferably, the nonpermanent adhesive can be such that it will lose or see a decrease in the tackiness thereof once the opening portion is separated from the second layer.

Preferably, the portion of the adhesive layer that is located outside the area adjacent to the opening portion can be permanent adhesive. Therefore, the first and second layer stay attached at all regions except the opening portion.

An outer film, whether a multilayer structure or a single layer can also include an optional tearing component. The optional tearing component can be positioned substantially over at least a portion of the first line of weakness on the outer surface of the outer film. The tearing component can include a label; paper, polymer or metal adhered to or otherwise affixed to the outer surface of the outer film; other materials; or any combination thereof. The optional tearing component can aid in opening the container, for example, it can aid in breaking one or more lines of weakness in the outer film.

An outer film can also include an optional line of weakness that would be positioned on the rear wall of the box once the outer film has been disposed on the housing. This optional line of weakness, a rear line of weakness, can be utilized to afford the option of removing a portion of the outer film on the rear of the lid/box separately. This optional line of weakness could be placed such that breaking this line of weakness would only expose the hinge line or would expose the hinge line and remove the covering wrapper from the lid. This optional rear line of weakness could be offset from the first line of weakness, and other lines of weakness that may be present, such that the rear line of weakness would have to be separately broken.

Containers described herein can be opened by breaking one or more lines of weakness in the outer film. After the one or more lines of weakness are broken, the lid of the housing can be hingedly moved away from the box and the contents of the container can be accessed. After the container is opened, the outer film is maintained on the housing of the container. The outer film comprises at least a covering portion that is maintained on the housing after opening and an opening portion that is removed from the container. The covering portion, even after the container is open maintains coverage over at least the hinge line on the back wall of the housing and preferably maintains coverage over substantially the entire container.

The opening portion generally follows the opening line of the housing. The opening portion allows the outer film to be broken or open so that the housing itself can be opened. The opening portion is either broken, where the opening portion includes only one or more lines of weakness, or removed, where the opening portion includes at least two lines of weakness and material of the outer film therebetween. The outer film can be a single layer or a multilayer. Where the outer film is a single layer, a single line of weakness can be used to open the outer film; a single line of weakness in combination with a tearing component can be used to open the outer film; more than one line of weakness can be used to open the outer film; or some combination thereof.

In some embodiments, a container comprises an outer film having an opening portion with one line of weakness that extends all the way through the entire thickness of the outer film. Such a container can have a label, a tearing component, in contact with outer film over the line of weakness. The covering portion of the outer film in such a container covers substantially 100 percent of the housing even after the container is opened. Such a container can be opened by removing the tearing component from the outer film, thereby breaking the line of weakness.

The container can also comprise an optional inner frame disposed within the box. The inner frame can be disposed inside the front wall of the box. Advantageously, an inner frame with a large surface area provided adjacent the front wall of the box increases the structural strength of the container. This is particularly advantageous for subsequent use when the container is no longer full. A container can also optionally include an inner liner. The inner liner can wrap the consumer goods. The inner liner and the consumer goods can collectively be referred to as an inner package.

A carton that includes a lid and at least one sidewall can contain multiple containers as described herein. A carton comprises, houses or holds at least one container. A carton can contain only disclosed containers or can contain disclosed containers as well as other items. In some preferred embodiments, a carton comprises, houses or holds from five to ten disclosed containers.

Definitions

The term "inner surface" is used throughout the specification to refer to the surface of a component of the assembled container that is facing towards the interior of the container, for example towards the consumer goods, when the container is in the closed position. For example, the outer film comprises an inner surface that is facing the housing of the container.

The term "outer surface" is used throughout the specification to refer to the surface of a component of the container that is facing towards the exterior of the container. For example, the outer film comprises an outer surface that is facing away from the housing of the container. It should be noted that the inside or outside surface is not necessarily equivalent to a certain side of a blank used in assembly of the container. Depending on how the blank is folded around the consumer goods, areas that are on the same side of the container can either face towards the inside or the towards the outside of the container.

The terms "front," "back," "upper," "lower," "top," "bottom," and "side" refer to the relative positions of portions of containers according to the invention and components thereof when the container is in an upright position with the lid of the housing in the closed position and the hinge line at the rear of the container. When describing containers according to the present invention, these terms are used irrespective of the orientation of the container being described. The rear or back wall of the container includes the hinge line.

Referring now to the drawings, in which some aspects of the present invention are illustrated.

Figure 1:
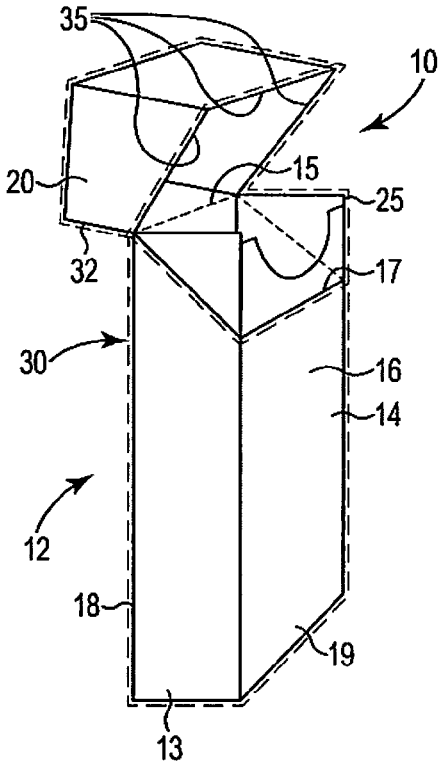
FIG. 1 is a schematic perspective view of a container in an open position, where the container includes a housing and an outer film.
Figure 2:
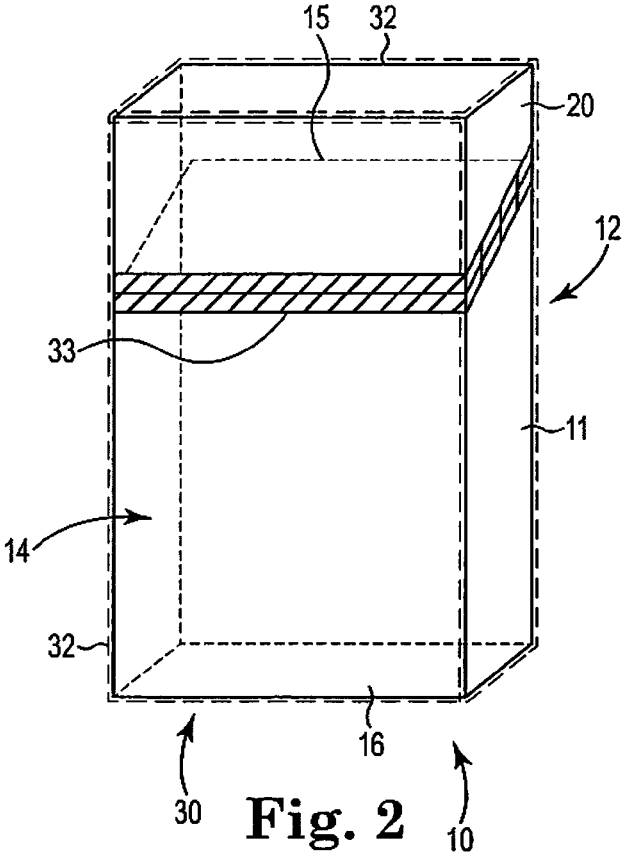
FIG. 2 is a schematic perspective view of the front of the container of FIG. 1 in a closed position.
Figure 3:
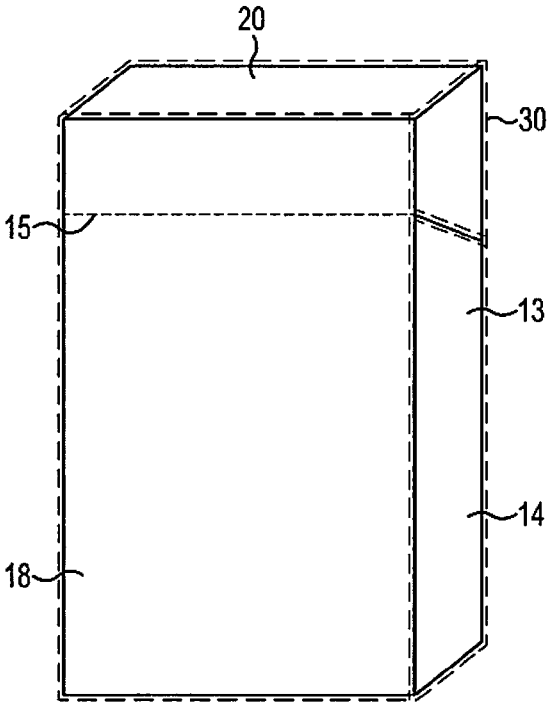
FIG. 3 is a schematic perspective view of the back of the container of FIG. 1 in a closed position.

FIGS. 1, 2 and 3 depict schematic perspective views (FIG. 1 side, FIG. 2 front and FIG. 3 back) of an embodiment of a container 10 for consumer goods. The container includes a housing 12 that includes a box 14 and a lid 20 hingedly attached to the box via a hinge line 15. The hinge line 15 extends across a rear wall 18 of the box 14 of the container 10, and acts to allow the lid 20 to be moved from a closed position (FIG. 2) to an opened position (FIG. 1). The box 14 includes an inner surface 17 and an outer surface 19, and the rear wall 18, a front wall 16 and two side walls 13 and 11. The box 14 and the lid 20 are defined by the opening line 35. The hinge line 15 has two end points on the rear wall 18 of the box 14 from which two points the opening line 35 begins and goes around the housing 12 circumferentially.

The container 10 also includes an outer film 30. The outer film 30, once the container has been opened (as is the case in FIG. 1) only includes the covering portion 32 which covers both the box 14 and the lid 20 but before opening (as is the case in FIG. 2) also includes the opening portion 33. It should be noted that the outer film 30 is depicted as having space between it and the housing 12. This space is depicted only for the sake of being able to visualize the outer film 30. Preferably, the outer film 30 is snug or tight around the housing 12 of the container 10.

An optional inner frame 25 can be disposed within the housing 12. The inner frame 25 can at least partially define an interior volume for housing consumer goods.

Figure 4:
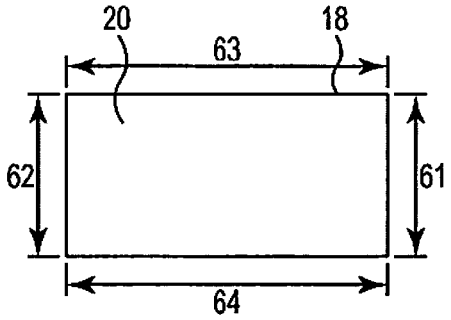
FIG. 4 is a top down view of the container of FIG. 1 showing the circumferential length of the housing.

The housing 12 has a circumferential length which is demonstrated in FIG. 4. As seen in FIG. 4, the circumferential length "x" of the housing is the total distance around the perimeter of the housing. Therefore, the circumferential length x in the depicted example is a+b+c+d, wherein "a" denotes the transversal width of the right side wall 11, as referenced in FIG. 4 by the reference numeral 61, "b" denotes the transversal width of the left side wall 13, as referenced in FIG. 4 by the reference numeral 62, "c" denotes the transversal width of the back wall 18, as referenced in FIG. 4 by the reference numeral 63 and "d" denotes the transversal width of the front wall 16, as referenced in FIG. 4 by the reference numeral 64.

Figure 5:
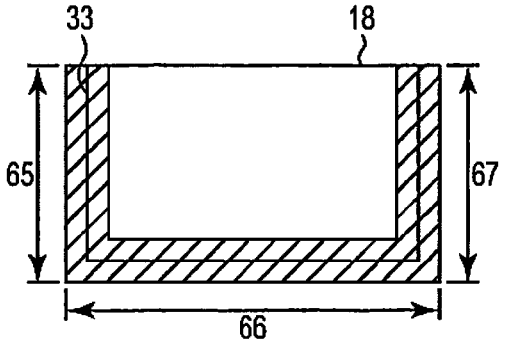
FIG. 5 is a top down view of the container of FIG. 1 showing the length of the opening portion.

The opening portion 33 has a length "y" which is demonstrated in FIG. 5. It is noted that the opening portion 33 is angled along the sides of the box 14. The length y in the depicted example is e+f+g, wherein "e" denotes the length of the portion of the opening portion along the left side wall 13, as referenced in FIG. 5 by the reference numeral 65, "f" denotes length of the portion of the opening portion along the right side wall 11, as referenced in FIG. 5 by the reference numeral 67 and "g" denotes the transversal width of the portion of the opening portion along the front wall 16, as referenced in FIG. 5 by the reference numeral 66. Because the opening portion 33 is angled along the sides of the box e is longer than b (in FIG. 4) and f is longer than a (in FIG. 4). In all embodiments, the length of the opening portion (y) is less than the circumferential length of the housing (x).

Figure 6:
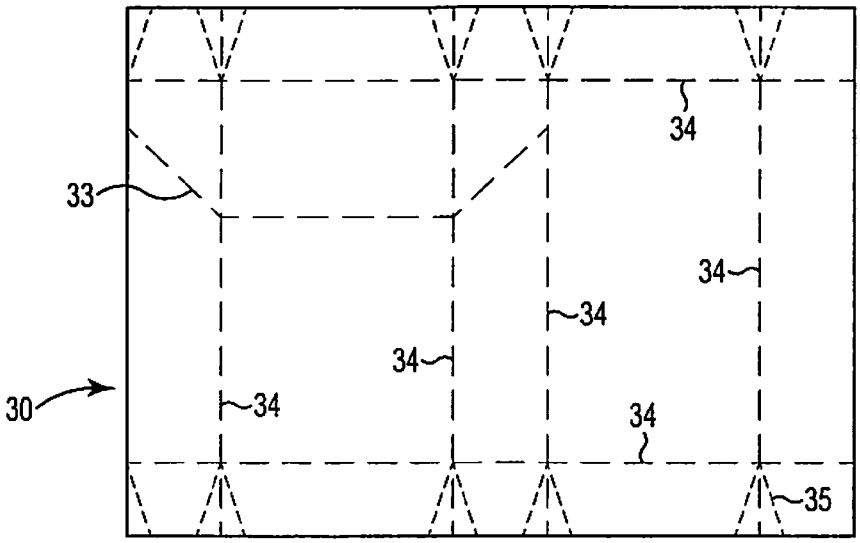
FIG. 6 is a schematic view of an outer film, not disposed around a housing having one line of weakness.
Figure 7:
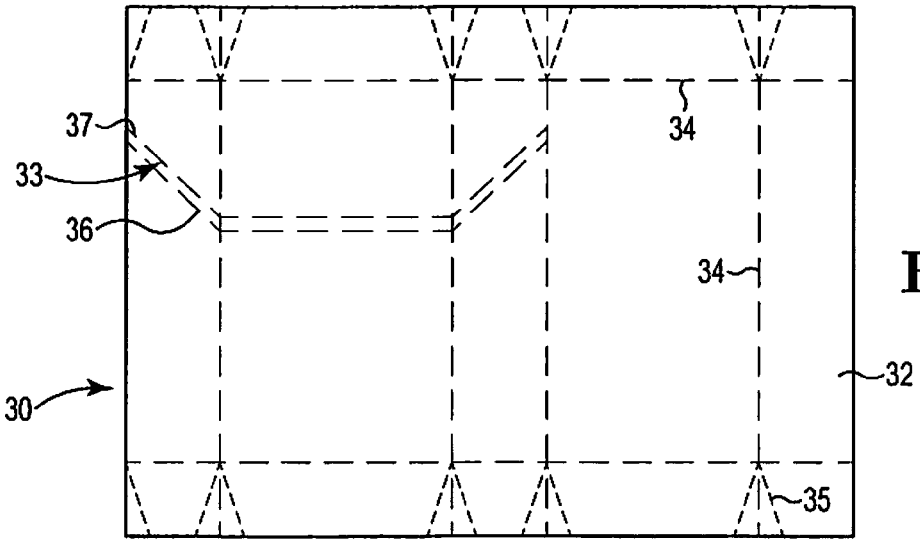
FIG. 7 is a schematic view of an outer film, not disposed around a housing having two lines of weakness.
Figure 8:
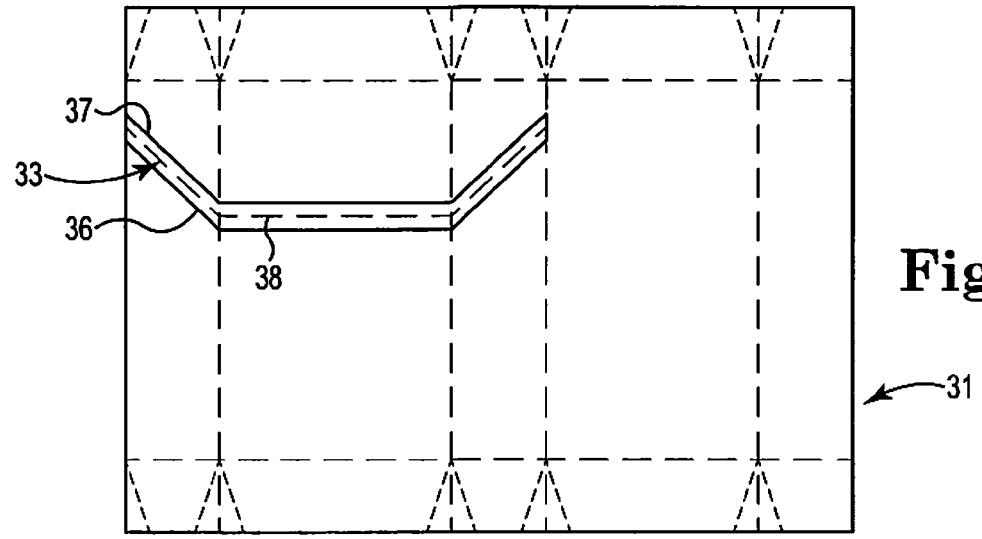
FIG. 8 is a schematic view of an outer film, not disposed around a housing having three lines of weakness.

FIG. 6 shows an outer film 30. The outer film 30 in FIG. 6 either has not yet been disposed around a housing or has been removed from a housing. The outer film 30 in FIG. 6 depicts the future edges 34 that once the outer film 30 is placed on a housing will reside on the edges of the housing. The outer film 30 in FIG. 6 also depicts fold lines 35 at which the outer film 30 can be folded in order to go around the edges of the housing. The outer film 30 includes an opening portion 33. The particular opening portion 33 depicted in FIG. 6 includes only a single line of weakness. FIG. 7 shows another outer film 30 that includes an opening portion 33 that includes two lines of weakness. The outer film 30 in FIG. 7 shows a first line of weakness 36 and a second line of weakness 37 that span or straddle the location where the opening line of the housing would be located once the outer film 30 has been placed on a housing. In this embodiment, the region between the first line of weakness and the second line of weakness forms the opening portion 33 and the remainder of the outer film 30 is the covering portion 32. FIG. 8 shows an outer film 31 that is a multilayer film. This outer film 31 includes a first line of weakness 36 and a second line of weakness 37 that are both in a first layer of the multilayer film. The outer film 31 also includes a third line of weakness 38 that is disposed between the first and second lines of weakness 36 and 37 but within the second layer. The region of the first layer between the first and second lines of weakness 36 and 37 is therefore the opening portion 33.

Figure 9:
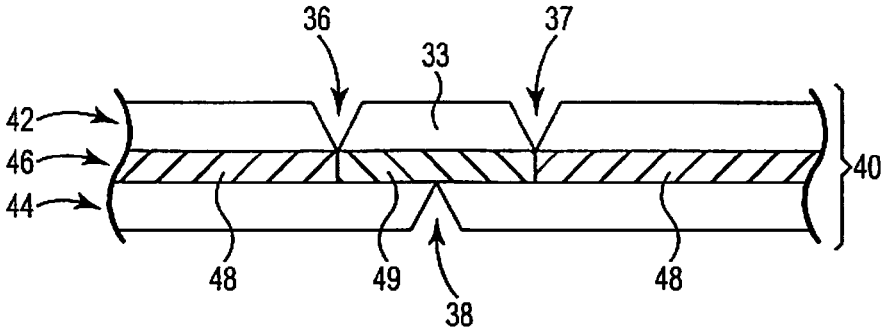
FIG. 9 is a schematic cross section of a portion of a multilayer outer film.

FIG. 9 is a schematic cross section of an illustrative multilayer outer film 40. The outer film 40 includes a first layer 42, a second layer 44 and an adhesive layer 46 disposed there between. The first layer 42 includes a first line of weakness 36 and a second line of weakness 37, and the second layer 44 includes a third line of weakness 38. The region of the first layer 42 between the first line of weakness 36 and the second line of weakness 37 is the opening portion 33. As seen in this figure, the third line of weakness is located in the second layer 44 but between the first line of weakness 36 and the second line of weakness 37. The adhesive layer 46 includes a first adhesive region 48 and a second adhesive region 49. The first adhesive region 48 can but need not be contiguous and can include the entire adhesive layer with the exception of the second adhesive region 49. As seen therein, the second adhesive region 49 is disposed in the adhesive layer 46 but between the first line of weakness 36 and the second line of weakness 37. In some illustrative embodiments, the first adhesive region 48 can include permanent adhesive and the second adhesive region 49 can include nonpermanent adhesive.

Figure 10:
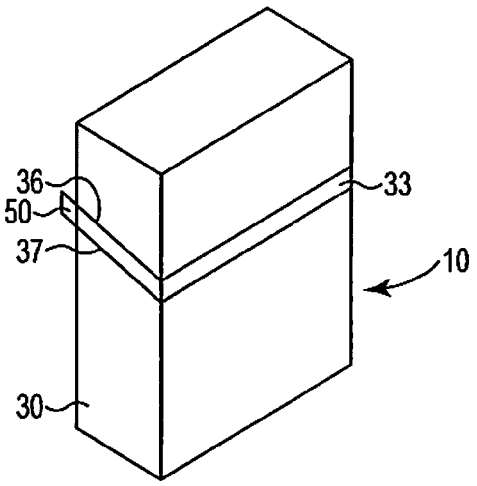
FIG. 10 shows an illustrative container before being opened.
Figure 11:
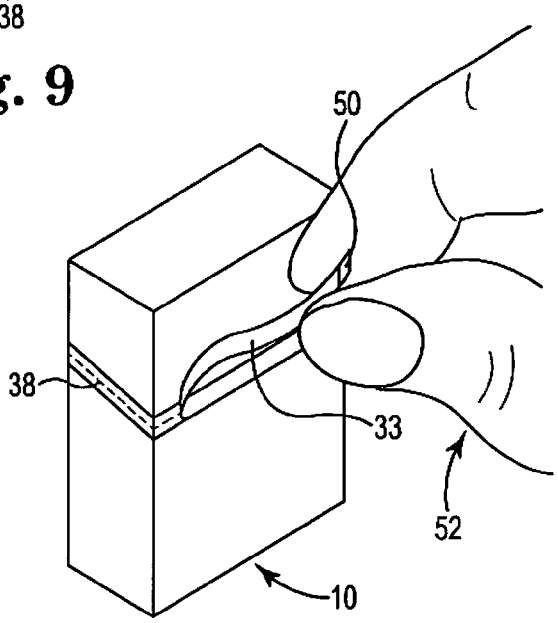
FIG. 11 shows an illustrative container while it is being opened.

FIG. 10 illustrates a container 10 that includes a first line of weakness 36 and a second line of weakness 37 in the outer film 30. The container 10 in FIG. 10 also illustrates an optional tearing component 50. The optional tearing component 50 is affixed or adhered to at least a portion of the opening portion 33. The optional tearing component 50 can make it easier for a consumer to remove the opening portion 33 from the container and thereby allows opening of the container 10. FIG. 11 illustrates the container when a consumer 52 is in the process of opening the container 10. The consumer 52 is removing the opening portion 33 by grasping (in this case) the optional tearing component 50.

Figure 12:
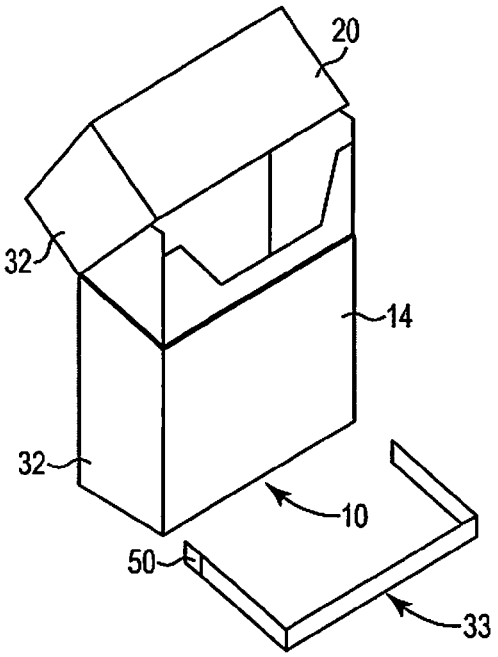
FIG. 12 shows an illustrative container after is has been opened.

Removal of the opening portion 33 reveals the third line of weakness 38. FIG. 12 illustrates the container 10 after the consumer has completed the process of opening the container 10. The opening portion 33 including the optional tearing component 50 has been completely removed from the container 10 while the covering portion 32 remains on the lid 20 and box 14. The lid 20 has been hingedly pushed away from the box 14 which simultaneously broke the third line of weakness opening the container 10.

The invention claimed is:

1. A container for consumer goods, comprising:

a housing having an inner surface, an outer surface, a rear wall and a circumferential length, the housing comprising a box, a lid, a hinge line and an opening line, where the lid is hingedly attached to the box at the hinge line on the rear wall of the housing, the hinge line having two end points adjacent the two ends of the opening line; and an outer film disposed on the outer surface of the housing, the outer film comprising a multilayer structure, the multilayer structure comprising a first layer and a second layer, the first layer comprising at least a first line of weakness and a second line of weakness, the second layer comprising a third line of weakness; and an adhesive layer positioned between the first layer and the second layer, the outer film comprising a covering portion and an opening portion, the opening portion having a length that is less than the circumferential length of the housing and the opening portion being disposed along the opening line of the housing, wherein the opening portion is removed to open the container.

2. The container of claim 1, wherein the entire covering portion remains attached to the housing even after the housing is opened.

3. The container of claim 1, wherein the covering portion makes up at least 90 percent of the outer film.

4. The container of claim 1, wherein the first and second line of weakness are within 1 mm to 5 mm, perpendicularly, of the opening line on the top and bottom of the opening line respectively.

5. The container of claim 1, wherein the first and second line of weakness are within 1 mm to 3 mm, perpendicularly, of the opening line on the top and bottom of the opening lines respectively.

6. The container of claim 1, wherein the opening portion of the outer film is the portion of the first layer between the first and second line of weakness.

7. The container of claim 1, wherein the adhesive layer comprises a nonpermanent adhesive region; and a permanent adhesive region, the nonpermanent adhesive region being positioned between the first and second line of weakness.

8. The container of claim 4, wherein the adhesive layer comprises a nonpermanent adhesive region; and a permanent adhesive region, the nonpermanent adhesive region being positioned between the first and second line of weakness.

9. The container of claim 1, wherein the third line of weakness is positioned between the first and second lines of weakness.

10. The container of claim 1, wherein the opening portion comprises the first line of weakness.

11. The container of claim 10, wherein the covering portion comprises substantially 100 percent of the outer film.

12. The container of claim 1, wherein the opening portion is formed from the outer film by mechanical cutting; use of a laser; degraded using UV energy, IR energy, Gamma energy, X-ray energy, chemical treatment, thermal treatment, galvanic treatment, or any combination thereof; or any combination thereof.

13. The container of claim 1, wherein the first line of weakness, the second line of weakness, the third line of weakness, or any combination thereof have an average thickness from 1 micrometers to 40 micrometers.

14. The container of claim 1 further comprising a tearing component laminated on the outer film directly over at least a portion of the opening portion.

15. A container for consumer goods, comprising:

a housing having an inner surface, an outer surface, a rear wall and a circumferential length, the housing comprising a box, a lid, a hinge line and an opening line, where the lid is hingedly attached to the box at the hinge line on the rear wall of the housing, the hinge line having two end points adjacent the two ends of the opening line; and an outer film disposed on the outer surface of the housing, the outer film comprising a multilayer structure, the multilayer structure comprising a first layer and a second layer, the first layer comprising at least a first line of weakness and a second line of weakness, the second layer comprising a third line of weakness; and an adhesive layer positioned between the first layer and the second layer, the outer film comprising a covering portion and an opening portion, the opening portion being the portion of the first layer between the first and second line of weakness and having a length that is less than the circumferential length of the housing and the opening portion being disposed along the opening line of the housing, wherein the opening portion is removed to open the container.

16. The container of claim 15, wherein the opening portion comprises the first line of weakness.

17. The container of claim 15, wherein the covering portion comprises substantially 100 percent of the outer film.

18. The container of claim 15, wherein the opening portion is formed from the outer film by mechanical cutting; use of a laser; degraded using UV energy, IR energy, Gamma energy, X-ray energy, chemical treatment, thermal treatment, galvanic treatment, or any combination thereof; or any combination thereof.

19. The container of claim 15, wherein the first line of weakness, the second line of weakness, the third line of weakness, or any combination thereof have an average thickness from 1 micrometers to 40 micrometers.

20. The container of claim 15 further comprising a tearing component laminated on the outer film directly over at least a portion of the opening portion.

* * * * *